US005958159A

United States Patent [19]

Prandi

[11] Patent Number: 5,958,159

[45] Date of Patent: Sep. 28, 1999

[54] PROCESS FOR THE PRODUCTION OF A SUPERELASTIC MATERIAL OUT OF A NICKEL AND TITANIUM ALLOY

[75] Inventor: Bernard Prandi, Seythenex, France

[73] Assignee: Memometal Industries, Aiton, France

[21] Appl. No.: 09/005,193

[22] Filed: Jan. 9, 1998

[30] Foreign Application Priority Data

Jan. 16, 1997 [FR] France ..... 97 00598

[51] Int. Cl.[6] ..... C22F 1/10

[52] U.S. Cl. ..... 148/675; 148/676; 148/677; 148/402

[58] Field of Search ..... 148/675, 676, 148/677, 402, 312; 420/441

[56] References Cited

U.S. PATENT DOCUMENTS 4,894,100 1/1990 Yamauchi et al. .

FOREIGN PATENT DOCUMENTS 0143580 6/1985 European Pat. Off. .
0161066 11/1985 European Pat. Off. .
0167221 1/1986 European Pat. Off. .
0353816 2/1990 European Pat. Off. .
2117001 10/1983 United Kingdom .
9527092 10/1995 WIPO .

*Primary Examiner*—Deborah Yee
*Attorney, Agent, or Firm*—Dowell & Dowell, P.C.

[57] ABSTRACT

A process for the production of a superelastic material out of a nickel and titanium alloy, characterized by the fact that it consists in obtaining an ingot starting from a mixing of nickel and titanium consisting in 55.6%±0.4% in weight of nickel and to proceed with a thermal treatment of martensite plaquettes generation by subjecting said ingot during 5 to 45 minutes to a temperature comprised between 480 and 520° C. The process allows the obtaining of a truly superelastic material at room temperature.

21 Claims, 2 Drawing Sheets

PROCESS FOR THE PRODUCTION OF A SUPERELASTIC MATERIAL OUT OF A NICKEL AND TITANIUM ALLOY

BACKGROUND OF THE INVENTION

1. Field of the Invention

The present invention relates to a process for the production of a superelastic material out of a nickel and titanium alloy.

2. Brief Description of the Related Art

It is known to call "superelastic materials," the nickel and titanium alloys that had been subjected to a thermal and/or cold-reduction treatment. In the case of a martensitic alloy at room temperature, a cold-reduction treatment may lead to the formation of a so-called "cold-hammered martensite," which confers the material an approximately 4% elasticity. This precludes to qualify the obtained alloy as being "superelastic."

SUMMARY OF THE INVENTION

On the contrary, the process in accordance with the invention has the aim to produce a truly superelastic material thanks to a well thought-out choice of the composition of the titanium and nickel alloy, and to a thermal treatment of martensite plaquettes or small plates or platelets generated in the alloy.

This aim is obtained thanks to the process in accordance with the invention that is characterized by the fact that it consists in obtaining an ingot from a mixing of nickel and titanium consisting in 55.6%±0.4% in weight of nickel and to proceed with a thermal treatment of martensite plaquettes generation by subjecting the ingot to a temperature comprised between 480 and 520° C. for a period from 1 to 60 minutes.

Thanks to the process of the present invention, the obtained ingot has a transition temperature at the end of the austenite $A_f$ manifestation lower than 20° C. under stress, so that the material is truly superelastic under regular temperature conditions. The thermal treatment of the martensite plaquettes generation facilitates the movement of these strips to the inside of the material, which corresponds to its superelastic nature.

In accordance with a first advantageous aspect of the present invention, the process also includes a flash annealing phase, being this flash annealing performed at a temperature comprised between 600° and 800° C. during a 10 to 30 second period, which period depends on the transversal dimensions of the piece. This flash annealing allows a partially annealing of the surface of the workpiece, which increases its ductility without impairing its elasticity.

In accordance with another advantageous aspect of the present invention, the process includes a crystallization annealing phase prior to the thermal treatment of martensite plaquettes generation, this crystallization annealing being conducted at a temperature between 700 and 800° C., preferably between 720 and 780° C., during a period of more than two minutes. The temperature range chosen for the crystallization annealing allows the obtaining of a true crystallization without precipitation of the nickel-rich alloy phases and without fatigue of the alloy because of grain amplification.

In accordance with another advantageous aspect of the present invention, the process includes a cold-reduction phase prior to the thermal treatment of the martensite plaquettes generation, which cold-reduction is comprised between 15 and 28%, preferably between 20 and 27%. The aim of the cold-reduction is to break up the annealing structure and to generate dislocations to serve as germination sites for the martensite of deformation.

Depending on the case, this cold-reduction can be performed either by cold or by warm process, that is to say, at a temperature lower than 500° C., In accordance with another advantageous aspect of the present invention, the cold-reduction can be performed with an intermediary annealing, at a temperature comprised between 400 and 550° C.

BRIEF DESCRIPTION OF THE DRAWINGS

The invention will be better understood and some other of its advantages will be shown more clearly through the below description of a process for the production of a wire frame for eyewear in accordance with its principle, given only by way of example and making reference to the accompanying drawings wherein.

DESCRIPTION OF THE PREFERRED EMBODIMENT

Figure 1:
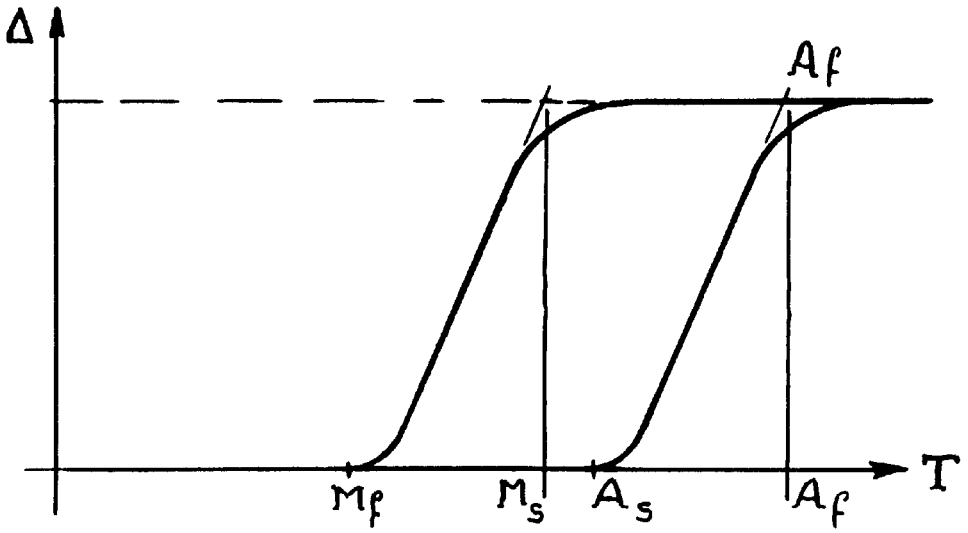
FIG. 1 illustrates a schematic representation of the deformation obtained depending on the temperature according to the phases present in a metallic alloy.

For the production of a superelastic material such as a wire for the frame of eyewear, the choice of the composition of the alloy is made depending on the four characteristic temperatures of the transition between the martensitic and the austenitic state. The characteristic temperatures are the following:

- $A_s$ is the temperature at the onset of the austenite manifestation, starting from the martensitic state;
- $A_f$ is the temperature at the end of the austenite manifestation, starting from the martensitic state;
- $M_s$ is the temperature at the onset of the martensite manifestation, starting from the austenitic state, and
- $M_f$ is the temperature at the end of the martensite manifestation, starting from the austenitic state.

An alloy is truly superelastic when the martensite of deformation generated under a stress $\Sigma$ is not stable. In order to obtain a superelastic material within a range of temperatures corresponding to a regular use, e.g., above −20° C., it is advisable that the alloy would not be at the martensitic state within this temperature range. In other words, an alloy is sought whose temperature $M_s$ would be lower than −20° C.

In practice, it was proven that the temperature difference separating $M_s$ and $A_f$ is approximately 40° C. for titanium and nickel alloys, so that, in order to observe the above-stated condition, it is advisable to have an alloy whose temperature $A_f$ under stress is lower than 20° C. On the other hand, the effect of a stress on a titanium and nickel alloy affects the previously identified temperatures to such an extent, that they can be driven upwards approximately 30° C. This is because of the fact, when a temperature $A_f$ lower than 20° C. under stress is sought, it is necessary to provide for an alloy composition in which $A_f$ is lower than −10° C. in the absence of a stress.

In an experimental manner it was determined that the $A_f$ condition lower than −10° C. corresponds to a nickel-rich titanium and nickel alloy, that is to say, containing nickel at a proportion of 55.6%±0.4% in weight, with eventually the conventional alloying elements, such as iron, copper or vanadium, these elements being in substitution of nickel in accordance with rules known to the experts in the field. Particularly interesting results were obtained in the case when the nickel percentage is comprised between 55.8 and 56% in weight.

On the other hand, tests on an alloy of which the temperature $A_f$ was equal to 20° have shown that the alloy is well elastic at 20° C. but on the border line. As a matter of fact, at 15° C., the alloy presents a "soft" component, a sign that the martensite is stable, while at 25° C., the alloy is quite elastic. This proves that the limit determined thanks to $A_f$ corresponds to a physical reality connected with the utilization of the material.

Thus, the process in accordance with the present invention begins with a phase 1 of mixing nickel and titanium at the selected proportions.

The phase 1 is followed by a fusion 2, at a temperature of approximately 1300 to 1500° C., leading to a first hot transformation of the ingot, namely to a temperature comprised between 900 and 1000° C., represented by phase 3. Several successive phases of cold-reduction 4 and several phases of annealing 5 of the ingot can be provided, which is illustrated by the bracket-arrow $F_1$ in FIG. 3.

Figure 2:
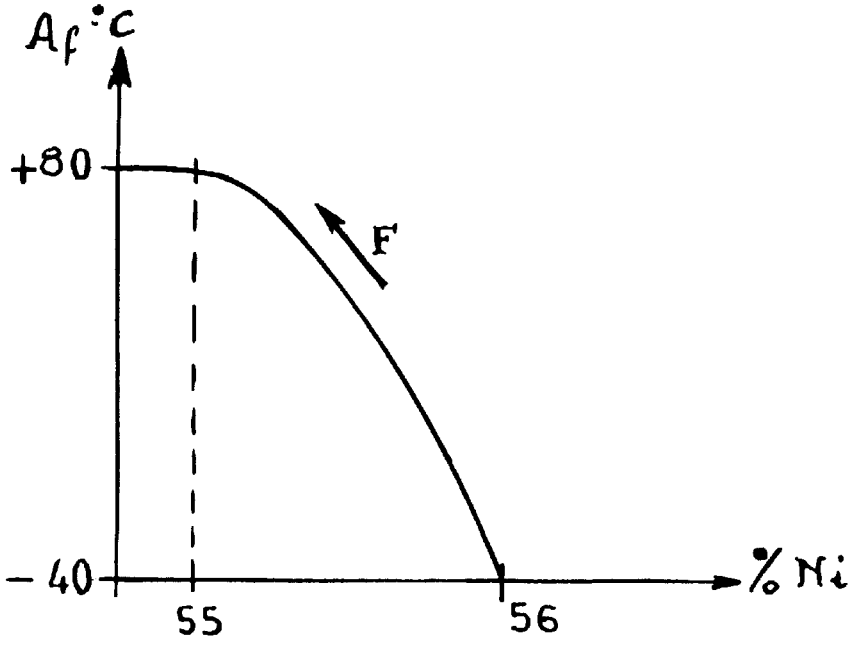
FIG. 2 illustrates a schematic representation of the value of the transition temperature at the end of austenite manifestation depending on the percentage of nickel in a nickel and titanium alloy.
Figure 3:
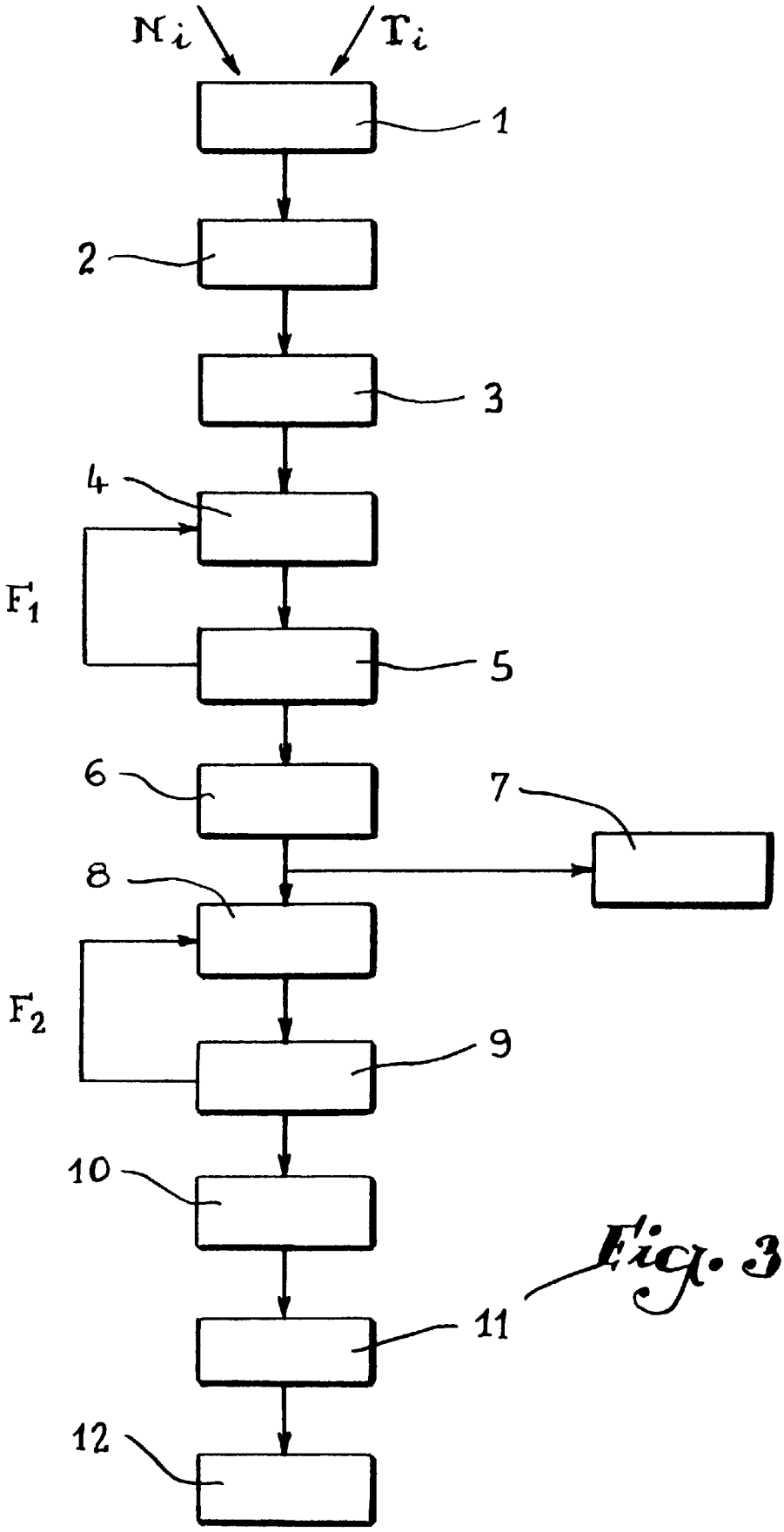
FIG. 3 illustrates a block diagram of the process in accordance with the present invention.

The thermal treatment of martensite plaquettes generation included in the process of the present invention, that is represented by phase 12 in FIG. 3, must not affect in a negative manner the transition temperature $A_f$, that is to say, to increase this temperature. Well now, in the thermal treatments performed at a temperature lower than roughly 450° C., the thermal treatment may have as effect the precipitation of $TiNi_3$, of $Ti_2Ni_3$ or of $Ti_2Ni_4$. Taking into account the relative number of nickel and of titanium atoms in each molecule of $TiNi_3$, of $Ti_2Ni_3$ or of $Ti_2Ni_4$, this precipitation corresponds to a decrease of the relative value of nickel in the alloy, so that the transition temperature is changed according to the arrow F in FIG. 2, increasing in the not desired direction. Thus, during the thermal treatment, it is important to avoid as much as possible the formation of $TiNi_3$ or of other similar compounds. Experimentally, it was possible to determine that no or only a little $TiNi_3$ is formed if the thermal treatment is performed at a temperature higher than 480° C.

In other respects, a treatment beyond 550° starts to anneal the structure of the alloy and leads to possibilities of plasticity. Experience has shown that this phenomenon is produced starting at 530° C. In consideration of the foregoing, the limit of the thermal treatment temperature is set at 520° C. Thus, the thermal treatment of the martensite plaquettes generation does not impinge on the alloy composition and on the structure of the material during the treatment.

In accordance with a first advantageous aspect of the present invention, the process also includes a flash annealing phase 11 prior to the thermal treatment of the martensite plaquettes generation. This phase 11 can be performed also subsequent to the treatment 12. This flash annealing is performed at a temperature comprised between 600 and 800° C. during a 10 to 30 seconds period. This period depends on the transversal dimensioning of the wire, that is to say, its diameter. The aim of the flash treatment is to improve the ductility, that is to say, the resistance to the fatigue of the material, without impairing the superelastic effect. This is obtained if a fraction of approximately 10% of the mass of the material is annealed in the proximity of its surface. In practice, and in order to be more consistent with the other phases of the process in accordance with the invention, this flash annealing can be performed at a temperature comprised between 720° and 780° C.

Advantageously, prior to the thermal treatment of the martensite plaquettes generation, a crystallization annealing treatment phase 6 is also provided. This crystallization annealing must bring about a true recrystallization of the entire workpiece, that is to say, that the grains elongated during the rolling process must be fractured in order to form smaller grains.

This crystallization annealing must be sufficiently long in order to bring the entire workpiece to the desired temperature. For a wire having a reduced diameter, this is accomplished after approximately two minutes. For a voluminous workpiece or a complete bundle of wire, the crystallization annealing may take longer than one hour.

As before, it is necessary to avoid precipitating nickel-rich phases of $TiNi_3$ type, which would cause an impoverishment in nickel of the alloy and would lead to an increased value of the transition temperature $A_f$ according to the arrow F in FIG. 2. In practice, it was proven that the precipitation of $TiNi_3$ can be prevented if the temperature of the recrystallization annealing 6 is maintained at higher than 700° C. As a matter of fact, tests were conducted at approximately 680° C. and it was demonstrated that the temperature $A_f$ shifted approximately 10° C., which is unacceptable. To be on the safe side, one can choose to perform the annealing at a temperature higher than 720° C.

It must be noted that the above contemplated limit of 700° C. is not significant for the flash annealing, inasmuch as its very short duration does not allow an effective precipitation of $TiNi_3$ or of other titanium and nickel compounds. This is why the flash annealing can be performed only at a temperature higher than 600° C.

In other respects, beyond approximately 850° C., the annealing treatment has a tendency to embrittle the alloy through an enlargement of the grains, and even through burning if the annealing temperature reaches 900° C. This is the reason why, to be on the safe side, the annealing temperature is limited to roughly 800° C.

Particularly satisfactory results were obtained by maintaining the annealing temperature between 720 and 780° C.

It can be provided in particular that at the beginning of the annealing treatment, a sample be taken in a phase 7 in order to check that the temperature $A_f$ remains below −10° C.

In accordance with an advantageous variant of the present invention, a cold-reduction phase 8 is also provided in the process, in order to the break up the annealing structure and to generate dislocations to serve as germination sites for the martensite of deformation. The tests conducted have shown that when this cold-reduction is limited to 15%, "annealed" austenite remains inside the material and that the superelastic effect is not the best. In such a case, one talks about a "soft" component of the material.

Furthermore, it has been demonstrated that a cold-reduction of higher than 30% does not bring about a better result in comparison with a cold-reduction of 28%. Moreover, a very significant cold-reduction affects in a negative manner the hardness and resistance to fatigue of the material, so that in practice, the cold-reduction is limited to values comprised between 15 and 28% and, to be on the safe side, as a general rule, one works with between 20 and 27% of cold-reduction.

This cold-reduction can be performed in one or several phases, which is represented by the bracket arrow $F_2$ in FIG.

3, be it through cold or warm process, that is to say, at a temperature lower than 500° C.

Eventually, an intermediate annealing phase 9 can be provided at a temperature comprised between 400° and 550° C. in order not to generate a new recrystallization of the alloy. This intermediate annealing allows an easier shaping of the workpiece, improving the elastic elongation that could be obtained.

Prior to the thermal treatment 11, the wire is calibrated in a shaping phase 10.

A superelastic material obtained thanks to the present invention finds many applications. In particular, the process can be used for the manufacture of wires whose diameter is comprised between 0.5 and 5 mm that could be used for eyewear frames, but also for the reinforcements of a brassiere, for the antennas of portable telephones, for needles, for prosthetic pieces or, in the medical field, for the ancillary material intended for the fitting of prostheses. The section of these wires can be round, square, rectangular or any other shape the user may choose.

What I claim is:

1. A process for the production of a superelastic material made out of a nickel and titanium alloy comprising the steps of:

a) providing a workpiece of a mixture of nickel and titanium consisting of 55.6%±0.4% in weight nickel and the balance substantially titanium, and b) subjecting the workpiece to a thermal treatment at temperatures between approximately 400 and 520° C. for a period of approximately 5 to 60 minutes to thereby generate martensite platelets within the workpiece and thereby form a material which is superelastic.

2. A process in accordance with claim 1 including an additional step of a reduction phase of the workpiece prior to said thermal treatment, the reduction phase being between 15 and 28%.

3. A process in accordance with claim 1 including an additional step of a crystallization annealing phase prior to said thermal treatment, the crystallization annealing phase being performed at a temperature between approximately 700 and 800° C. during a period of more than two minutes.

4. A process in accordance with claim 3 including an additional step of a reduction phase of the workpiece prior to said thermal treatment, the reduction phase being between 15 and 28%.

5. A process in accordance with claim 4 wherein the reduction phase is performed subsequent to the crystallization annealing phase.

6. A process in accordance with claim 4, wherein the reduction phase is performed by a cold process.

7. A process in accordance with claim 4 wherein the reduction phase is performed by a warm process at a temperature lower than approximately 500° C.

8. A process in accordance with claim 4 wherein the reduction phase is performed with an intermediate annealing at a temperature between approximately 400 and 550° C.

9. A process in accordance with claim 1 including an additional step of a flash annealing phase of the workpiece prior to the thermal treatment performed during approximately 10 to 30 seconds at a temperature between approximately 600 and 800° C.

10. A process in accordance with claim 9 including an additional step of a reduction phase of the workpiece prior to said thermal treatment, the reduction phase being between 15 and 28%.

11. A process in accordance with claim 9 including the additional step of a crystallization annealing phase of the workpiece prior to the thermal treatment, the crystallization annealing phase being performed at a temperature between approximately 700 and 800° C. during a period of more than two minutes.

12. A process in accordance with claim 11 including an additional step of a reduction phase of the workpiece prior to the thermal treatment, the reduction being between 15 and 28%.

13. A process in accordance with claim 12 wherein the reduction phase is performed subsequent to the crystallization annealing phase.

14. A process in accordance with claim 12 wherein the reduction phase is performed by a cold process.

15. A process in accordance with claim 12 wherein the reduction phase is performed by a warm process at a temperature lower than approximately 500° C.

16. A process in accordance with claim 12 wherein the reduction phase is performed with an intermediate annealing of the workpiece at a temperature between approximately 400 and 550° C.

17. The process of claim 2 wherein the cold reduction phase of the workpiece is between 20 and 27%.

18. The process of claim 3 wherein the crystallization annealing phase of the workpiece is performed at temperatures between approximately 720 and 780° C.

19. The process of claim 4 wherein the cold reduction phase of the workpiece is between 20 and 27%.

20. The process of claim 11 wherein the crystallization annealing phase of the workpiece is performed at temperatures between approximately 720 and 780° C.

21. The process of claim 12 wherein the cold reduction phase of the workpiece is between 20 and 27%.

* * * * *